US011447938B2

(12) United States Patent
Kunz

(10) Patent No.: US 11,447,938 B2
(45) Date of Patent: Sep. 20, 2022

(54) WEAR PART REMOVAL SYSTEM

(71) Applicant: Caterpillar Inc., Peoria, IL (US)

(72) Inventor: Phillip J. Kunz, Morton, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 17/152,502

(22) Filed: Jan. 19, 2021

(65) Prior Publication Data

US 2022/0228350 A1 Jul. 21, 2022

(51) Int. Cl.
*E02F 9/28* (2006.01)

(52) U.S. Cl.
CPC ..... *E02F 9/2891* (2013.01)

(58) Field of Classification Search
CPC .... Y10T 29/53974; E02F 9/00; E02F 9/2891; B23P 19/033
See application file for complete search history.

(56) References Cited

U.S. PATENT DOCUMENTS 2,259,742 A * 10/1941 Edison ..... E02F 9/2841 72/401
3,861,250 A * 1/1975 Zugai ..... B25B 27/18 81/464
4,512,222 A * 4/1985 Christophersen .... B25D 17/005 81/464
4,611,418 A * 9/1986 Launder ..... E02F 9/2891 403/328
5,774,978 A * 7/1998 Ishii ..... B23P 19/033 29/821
5,937,551 A * 8/1999 Moehnke ..... F16C 15/00 37/459
6,883,221 B1 * 4/2005 Hayes, III ..... B25B 27/04 29/253
7,520,570 B2 * 4/2009 Sansone ..... E02F 9/2891 299/95
7,891,084 B1 * 2/2011 Sollami ..... E02F 9/2866 29/760
9,488,449 B2 * 11/2016 Opperman ..... B25J 11/0025
10,988,916 B2 * 4/2021 Paul ..... B25J 5/007
11,015,324 B2 * 5/2021 Clarke ..... B25J 11/00
2007/0179328 A1 * 8/2007 Murakami ..... B25B 21/02 585/448
2009/0293249 A1 * 12/2009 Lehnert ..... E21C 35/19 29/270
2011/0191999 A1 * 8/2011 Clendenning ..... E02F 9/2891 29/275
2012/0222335 A1 * 9/2012 Charlton ..... E02F 9/2891 29/253

(Continued)

FOREIGN PATENT DOCUMENTS

AU 2014240371 B2 5/2015
RU 2016756 C1 7/1994
WO WO-2021056061 A * 4/2021 ..... E02F 9/2891

*Primary Examiner* — Jacob J Cigna
*Assistant Examiner* — Michael W Hotchkiss
(74) *Attorney, Agent, or Firm* — Harrity & Harrity LLP

(57) ABSTRACT

A wear part removal system includes a handle, a positioning system configured to control an approach angle of the wear part removal system to a wear part, a clamping system that includes a plurality of clamps and that is configured to clamp the wear part, a contact component configured to contact a portion of the wear part, and a vibrator device configured to generate a vibratory force that is to be transmitted to the wear part.

20 Claims, 8 Drawing Sheets

(56) References Cited

U.S. PATENT DOCUMENTS

| | | | | |
|---|---|---|---|---|
| 2012/0298706 | A1* | 11/2012 | Gordon | B25J 15/0491 224/401 |
| 2013/0104361 | A1* | 5/2013 | Corfitsen | B60L 53/80 29/402.08 |
| 2015/0107075 | A1* | 4/2015 | Clarke | E02F 9/2891 29/703 |
| 2017/0356167 | A1* | 12/2017 | Paul | B25J 5/007 |
| 2019/0321926 | A1* | 10/2019 | Paul | E02F 9/2891 |
| 2019/0360180 | A1* | 11/2019 | Carpenter | B25J 15/04 |
| 2020/0102722 | A1* | 4/2020 | Saunders | E02F 9/2891 |
| 2020/0263396 | A1* | 8/2020 | Clarke | B66C 13/40 |
| 2021/0370484 | A1* | 12/2021 | Widlroither | B25B 21/02 |

* cited by examiner

200

WEAR PART REMOVAL SYSTEM

TECHNICAL FIELD

The present disclosure relates generally to wear part removal and, for example, to a wear part removal system.

BACKGROUND

Earth-moving machines such as excavators, wheel loaders, and track-type tractors and loaders commonly include an implement structured for digging, cutting, breaking apart, removing, breaking, carrying, or otherwise manipulating materials such as rock, soil, sediment, or waste, to name a few examples. The implement is often subjected to regular and repeated wear along an edge of the implement caused by engagement with the materials. In order to protect the edge, the implement may include one or more replaceable wear parts (also referred to as ground engaging tools (GETs)), such as teeth, couplers, adapters, lip shrouds, caps, and/or the like. The one or more replaceable wear parts then bear the majority of the abrasion, impact, or other forces that typically cause wear or damage while the implement is in service.

Over time, due to wear or damage to a replaceable wear part, the replaceable wear part may degrade, fail, or otherwise need to be replaced. Replacing the replaceable wear part requires the replaceable wear part to be detached from an adapter or mount. However, this is often difficult because impacted fines, dust, or dirt on the replaceable wear part may cause the replaceable wear part to adhere to (e.g., be stuck on) the adapter or mount. This requires a large pulling force, or other means for removing or loosening the impacted fines, dust, or dirt, to enable removal of the replaceable wear part. For example, a worker may use hand tools to physically loosen and/or remove the replaceable wear part (e.g., use a sledge hammer to detach the wear part from an adapter). Further, environmental conditions, such as heat, cold, rain, snow, sleet, ice, uneven terrain, limited working area, and/or the like, make removing a replaceable wear part difficult and/or time consuming.

U.S. Patent Application Publication No. 2019/0360180 (the '180 publication) discloses a manipulator usable to remove and/or install wear parts on equipment in mining, construction, dredge and/or other working operations. Per the '180 publication, the manipulator includes a gripper assembly that holds wear parts when installing or removing them onto or off of earth working equipment. The manipulator can include a vibrator, which can cooperate with the gripper in removing ground-engaging wear parts from earth working equipment. For example, as disclosed in the '180 publication, the vibrator can vibrate arms of the gripper that grip the wear part.

While the '180 publication discloses a manipulator for removing a wear part, the manipulator contacts the wear part only via a gripper, which applies a pulling force on the wear part. Accordingly, vibrations created by a vibrator of the manipulator (e.g., that vibrates the arms of the gripper that grips the wear part) are not directly applied to the wear part. This can impact the manipulator's ability to remove or loosen impacted fines, dust, or dirt of the wear part, which impacts the manipulator's ability to remove the wear part via application of the pulling force by the gripper. Further, in some cases, when the wear part is worn and/or damaged, or the wear part is wet or covered in ice, among other examples, the gripper may not be able to maintain a grip on the wear part. Therefore, in such cases, the manipulator cannot remove the wear part. The wear part removal system of the present disclosure solves one or more of the problems set forth above and/or other problems in the art.

SUMMARY

In some implementations, a wear part removal system includes a handle; a positioning system configured to control an approach angle of the wear part removal system to a wear part; a clamping system that includes a plurality of clamps and that is configured to clamp the wear part; a contact component configured to contact a portion of the wear part; and a vibrator device configured to generate a vibratory force that is to be transmitted to the wear part.

In some implementations, a wear part removal system includes a positioning system configured to control an approach angle of the wear part removal system to a wear part; a clamping system that includes a plurality of clamps and that is configured to clamp the wear part to facilitate removal of the wear part; and a contact component configured to contact a portion of the wear part to facilitate the removal of the wear part.

In some implementations, a wear part removal system includes a positioning system configured to control and maintain an approach angle of the wear part removal system with respect to a wear part; and a clamping system that includes a plurality of clamps and that is configured to clamp the wear part to facilitate removal of the wear part, wherein a clamp, of the plurality of clamps, includes a component configured to engage a retention aperture of the wear part when the clamping system clamps the wear part.

DETAILED DESCRIPTION

This disclosure relates to a wear part removal system, which is applicable to any machine that needs removal of a wear part. The term "machine" may refer to any machine that performs an operation associated with an industry such as, for example, mining, construction, farming, transportation, or other industry. For example, the machine may be an earth-moving machine or material-moving machine, such as an excavator, a wheel loader, or a track-type tractor and loader, among other examples.

Figure 1A:
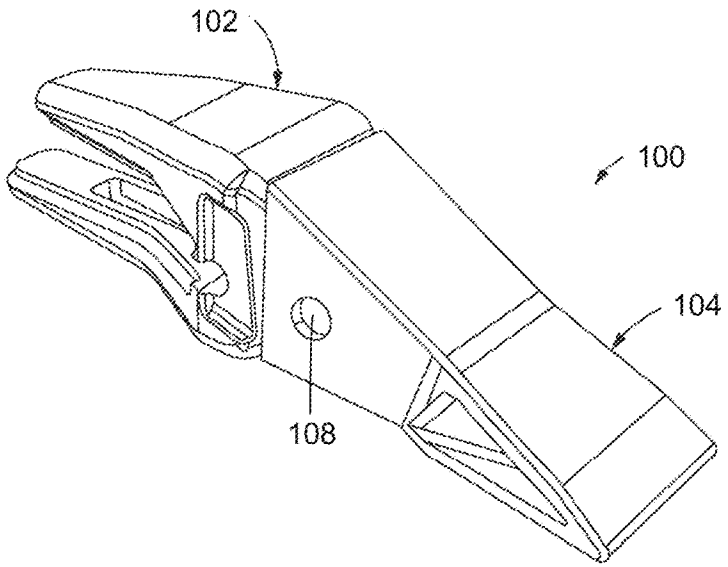
FIGS. 1A-1B are diagrams of an example wear part assembly described herein.
Figure 1B:
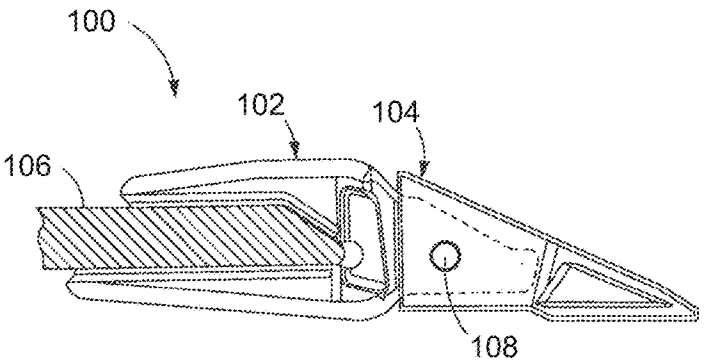

FIGS. 1A-1B are diagrams of an example wear part assembly 100. As shown in FIGS. 1A-1B, the wear part assembly 100 may include an adapter 102 for a wear part 104 (also referred to as a tip, a tooth, or a ground engaging tool (GET), among other examples). The adapter 102 may be configured to attach to and/or cover an edge of an implement 106 (e.g., a blade, a loader bucket, an excavator bucket, or any other implement having an earth-engaging or material-engaging edge that is subject to wear while in service). The wear part 104 may be configured to attach to the adapter 102 and may be configured to protect the edge of the implement 106 by covering the edge of the implement 106 and engaging with earth or material while the implement 106 is in service. The wear part 104 may include a retention mechanism (not shown) that secures the wear part 104 to the adapter 102. The retention mechanism may utilize aspects of the adapter 102 and the wear part 104, such as one or more retention apertures 108 on a side of the wear part 104, as shown in FIGS. 1A-1B, to secure the wear part 104 to the adapter 102 while the implement 106 is in service. As shown in FIGS. 1A-1B, when attached to the adapter 102, the wear part 104 may extend outwardly from the edge of the implement 106 for engagement with the earth or the material (not shown).

While a particular wear part assembly 100, adapter 102, and wear part 104 are shown in FIGS. 1A-1B, contemplated implementations include any type of wear part assembly, adapter, wear part, and/or the like (e.g., any coupler, mount, adapter, tooth, tip, lip shroud, cap, or any other GET), associated with an implement of a machine.

As indicated above, FIGS. 1A-1B are provided as an example. Other examples may differ from what is described in connection with FIGS. 1A-1B.

Figure 2A:
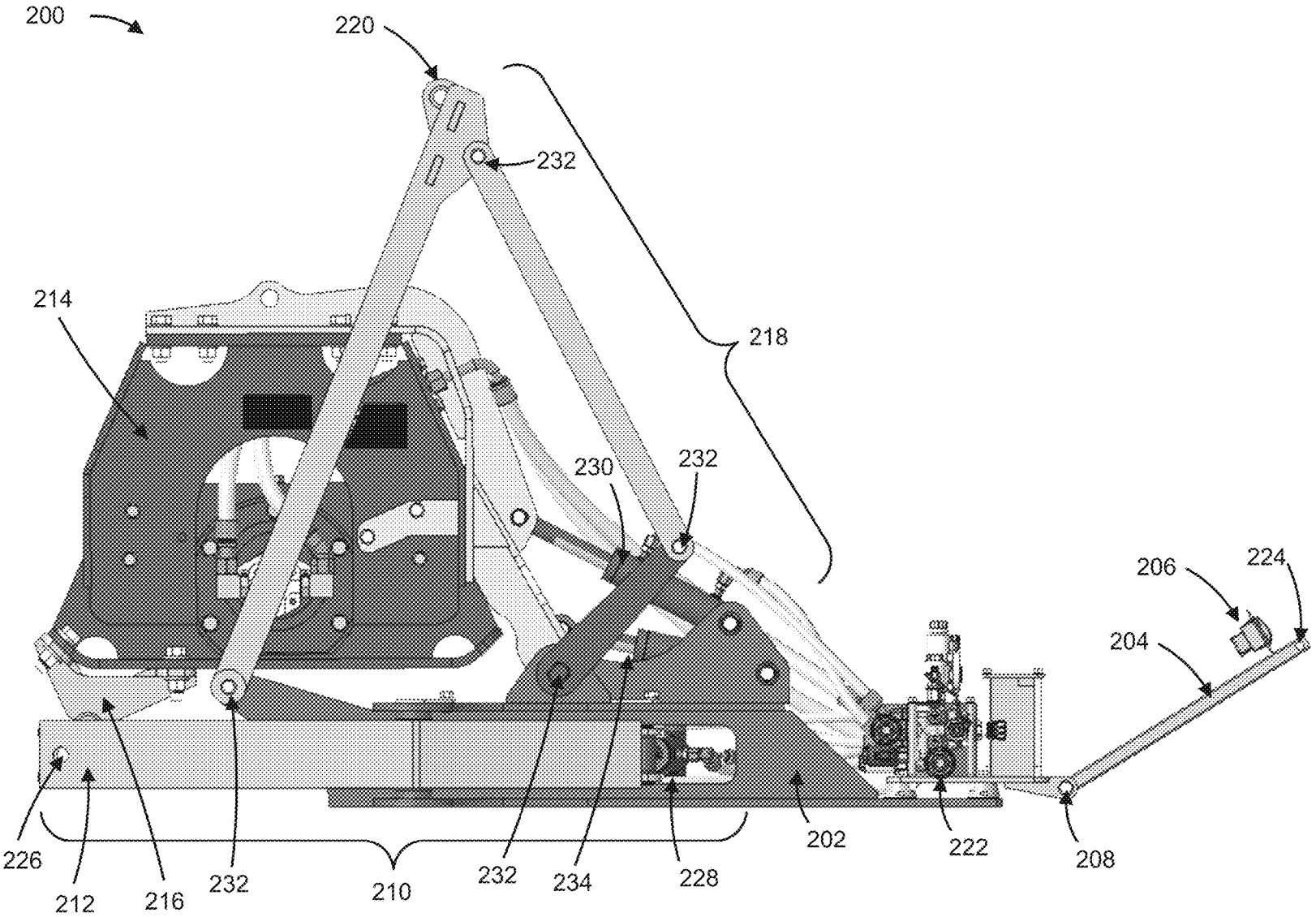
FIGS. 2A-2D are diagrams of an example wear part removal system described herein.
Figure 2B:
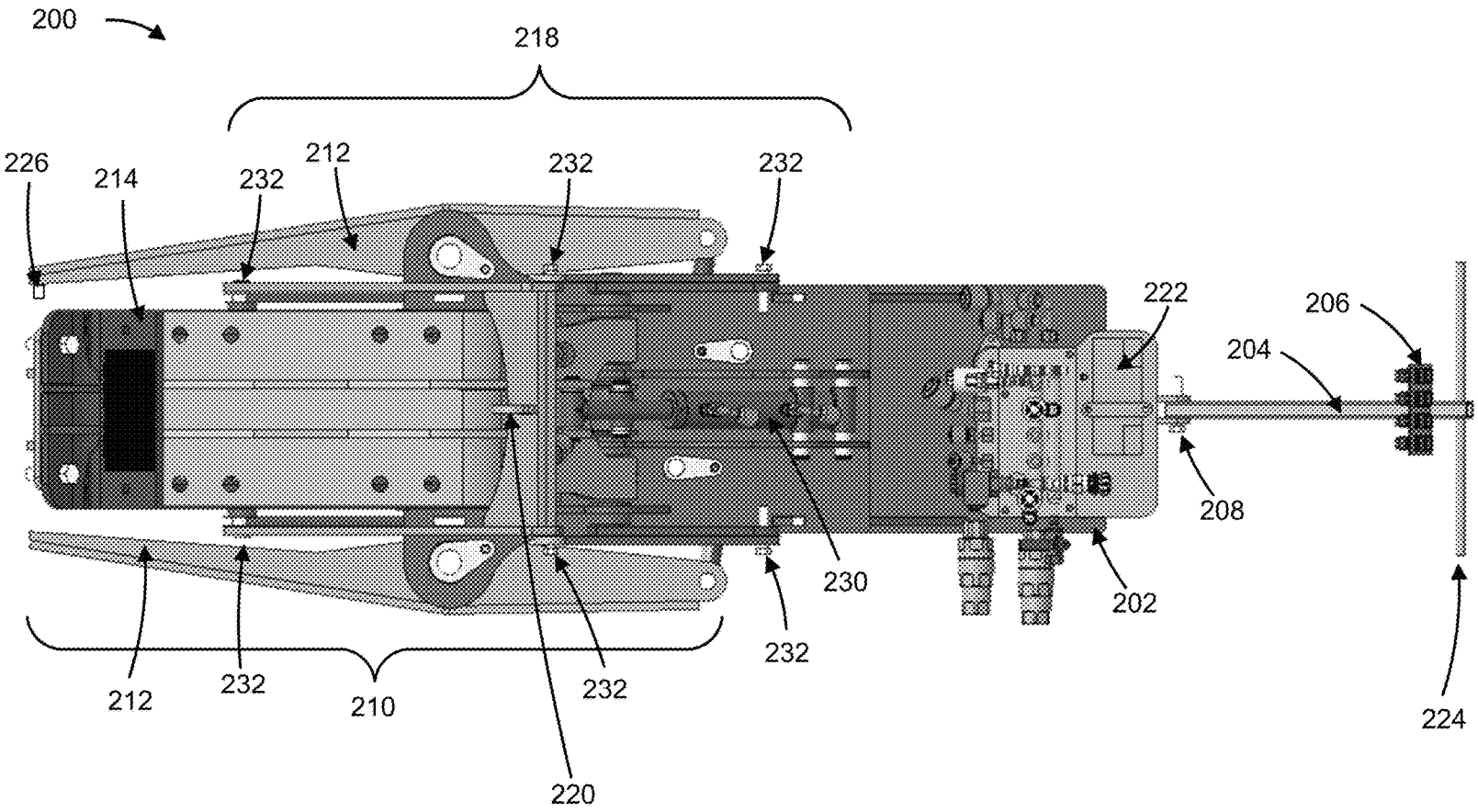
Figure 2C:
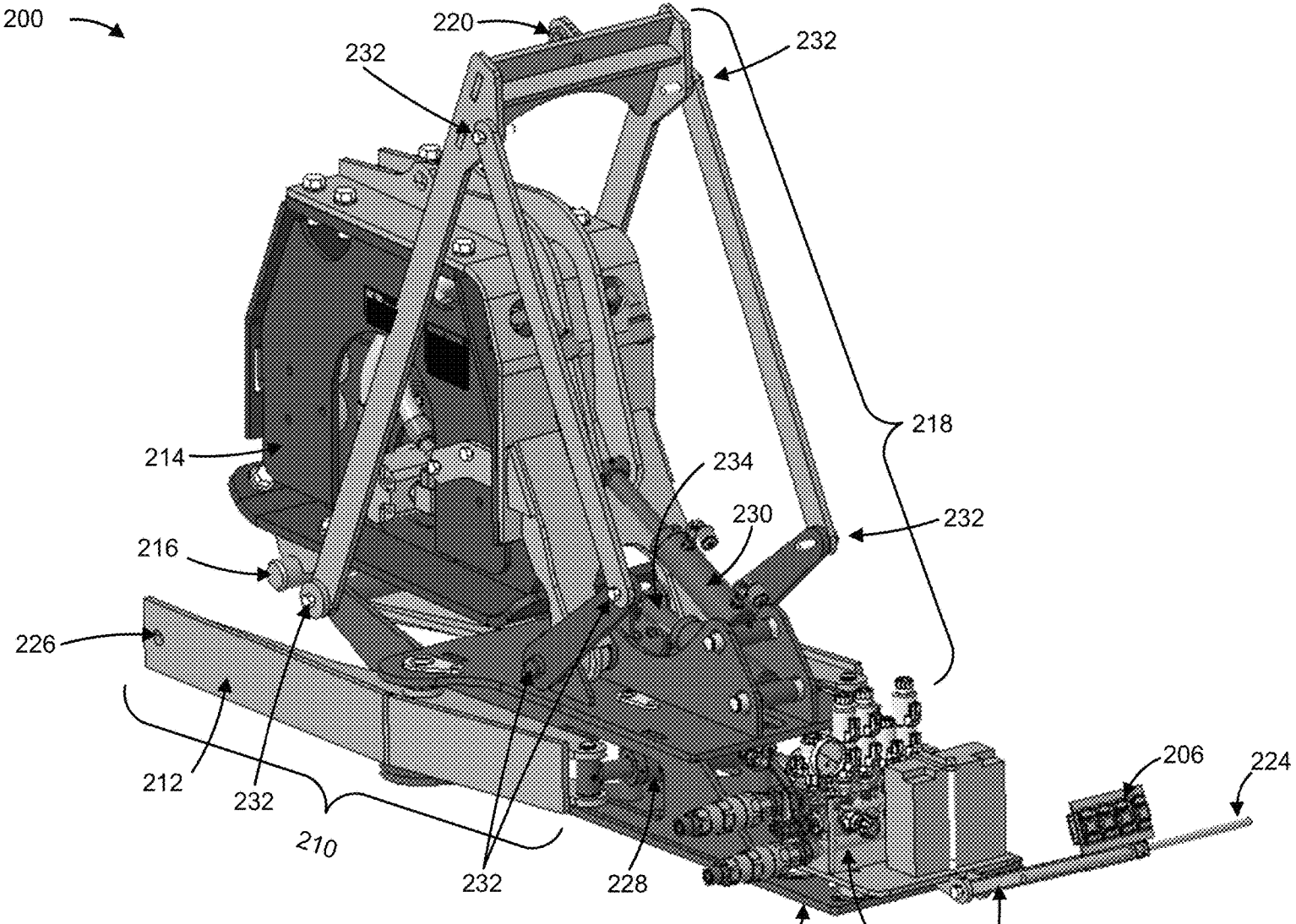
Figure 2D:
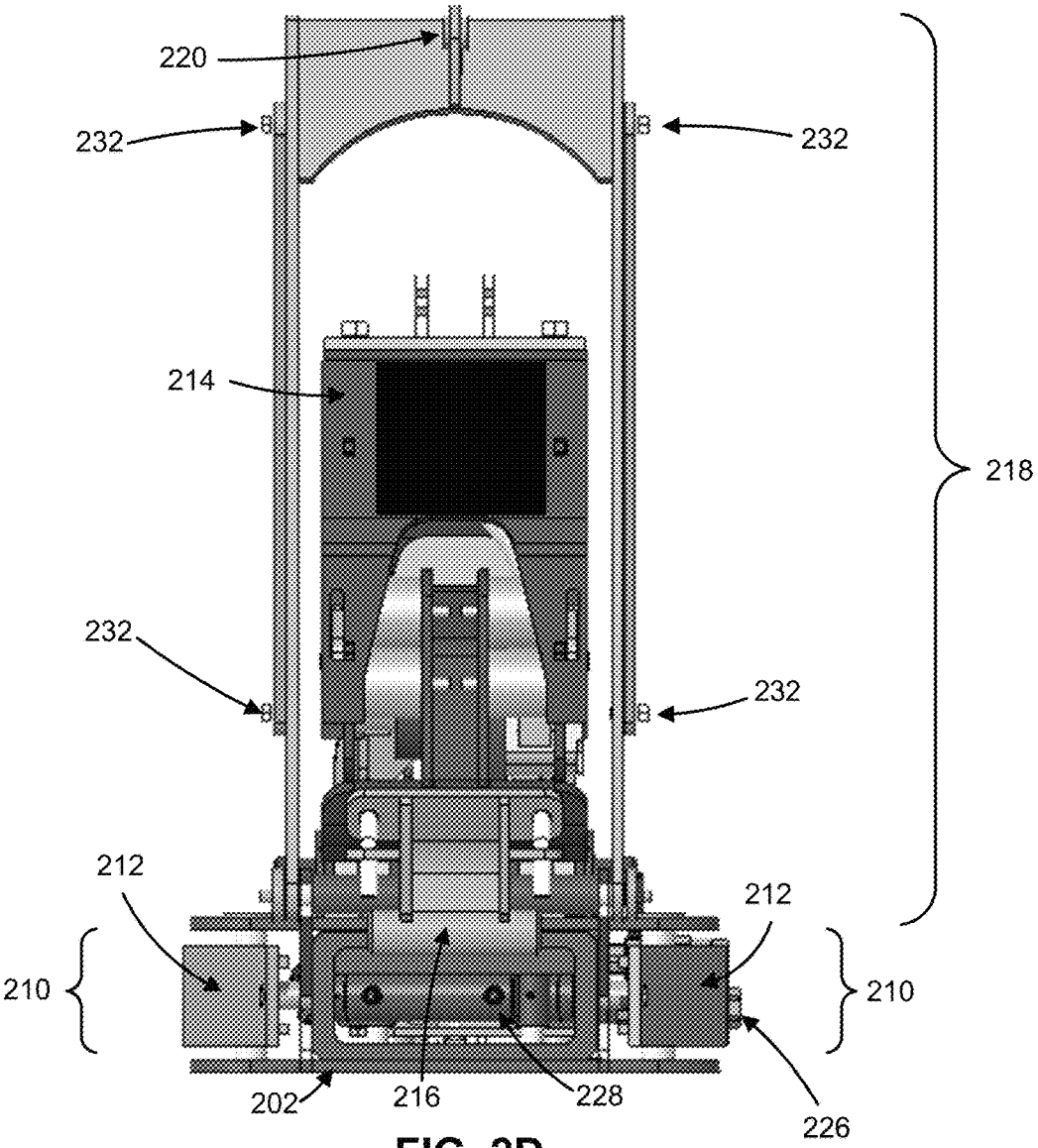

FIGS. 2A-2D are diagrams of an example wear part removal system 200 described herein. The wear part removal system 200 may be used to remove, or to facilitate removal, of the wear part 104. FIG. 2A is a side view of the wear part removal system 200. FIG. 2B is a top view of the wear part removal system 200. FIG. 2C is an angled side view of the wear part removal system 200. FIG. 2D is a front view of the wear part removal system 200.

As shown in FIGS. 2A-2D, the wear part removal system 200 may include a base 202, a handle 204 that may include one or more controls 206, a handle pivot point 208, a clamping system 210 that may include a plurality of clamps 212, a vibrator device 214, a contact component 216, a positioning system 218, and/or at least one suspension point 220.

The base 202 may provide a physical structure to support the handle 204, the clamping system 210, the vibrator device 214, the contact component 216, the positioning system 218, and/or one or more additional components of the wear part removal system 200. For example, the handle 204, the clamping system 210, the vibrator device 214, the contact component 216, the positioning system 218, and/or the one or more additional components of the wear part removal system 200 may be respectively attached to the base 202 by one or more fasteners. One or more hydraulic control components 222 may be attached to the base 202 to allow control (e.g., activation or deactivation, pressurization or depressurization, and/or the like) of one or more hydraulic actuators (e.g., as described below in relation to the clamping system 210, the vibrator device 214, and/or the positioning system 218) of the wear part removal system 200. The one or more hydraulic control components 222 may be connected to a hydraulic pump (not shown) that is configured to provide pressurized hydraulic fluid to the one or more hydraulic actuators via the one or more hydraulic control components 222.

The handle 204 may be pivotally connected to the base 202 by the handle pivot point 208. The handle pivot point 208 (e.g., that comprises a pivot pin or a similar pivoting component) may allow relative motion between the handle 204 and the base 202 (and/or other components of the wear part removal system 200). The handle pivot point 208 may allow the handle 204 to be secured or "locked" at a particular position relative to the base 202. In this way, an operator of the wear part removal system 200 may interact with the handle 204 via a handlebar 224 of the handle 204 to adjust and secure the handle 204 to a height and/or angle that allows the worker to operate the one or more controls 206, to exert a pushing force on the handle 204 (e.g., to guide the clamping system 210 to clamp the wear part 104 and/or the contact component 216 to contact the wear part 104) via the handlebar 224, to exert a pulling force on the handle 204 (e.g., to cause the clamping system 210 to exert a pulling force on the wear part 104 when the clamping system 210 is clamping the wear part 104) via the handlebar 224, and/or the like. In some implementations, the base 202 and/or the handle 204 may include a damper component (not shown) that is configured to reduce an amount of vibratory force (e.g., that is generated by the vibrator device 214, as described herein) that transmits to or through the handle 204 and/or the handlebar 224. In this way, the operator of the wear part removal system 200 is not subject to potentially jarring vibrations and may freely interact with the handle 204 (e.g., to exert a pulling force on the handle 204) via the handlebar 224 to facilitate removal of the wear part 104.

The handle 204 may include, or may be attached to, the one or more controls 206 (e.g., on or proximate to the handlebar 224). The one or more controls 206 may include one or more levers, knobs, switches, dials, buttons, and/or the like that are configured to control one or more components of the wear part removal system 200. For example, the one or more controls 206 may be configured to control a tilt angle of the contact component 216 (e.g., to allow the contact component 216 to contact the wear part 104, as described herein), an approach angle of the wear part removal system 200 (e.g., to allow the clamping system 210 to clamp the wear part 104 and/or the contact component 216 to contact the wear part 104, as described herein), activation or deactivation of the clamping system 210 (e.g., to cause the plurality of clamps 212 to clamp or release the wear part 104), activation or deactivation of the vibrator device 214 (e.g., to cause the vibrator device to generate or to cease generating a vibratory force, as described herein), and/or the like. In some implementations, the operator of the wear part removal system 200 may interact with the one or more controls 206 to control the one or more components of the wear part removal system 200 to facilitate removal of the wear part 104. The one or more controls 206 may send one or more control signals (e.g., after the operator interacts with the one or more controls 206) to the one or more hydraulic control components 222 to control (e.g., to activate or deactivate, pressurize or depressurize, and/or the like) the one or more hydraulic actuators of the wear part removal system 200, as described herein.

The clamping system 210 may include the plurality of clamps 212 configured to clamp the wear part 104 (e.g., to facilitate removal of the wear part 104). The plurality of clamps 212 may be configured to clamp side surfaces of the wear part 104. In this way, the plurality of clamps 212 may apply a clamping force on the wear part 104 (e.g., to facilitate application of a pulling force, a pushing force, and/or a vibratory force on the wear part 104, as described herein). For example, the plurality of clamps 212 may apply approximately 4,000-6,000 pounds (lbs) of clamping force on the wear part 104. A clamp 212, of the plurality of clamps 212, may include an engagement component 226 (e.g., a pin, rod, or other fastener) to engage with the retention aperture 108 of the wear part 104 when the clamping system 210 clamps the wear part 104. The engagement component 226 may insert into the retention aperture 108 and may allow the clamp 212 to clamp the wear part 104 without (or with only a minimal amount of) slippage. In some implementations, a clamp 212, of the plurality of clamps 212, may include a non-slip component (not shown) comprising a friction inducing material, such as rubber, that is configured to provide grip on the wear part 104 when the clamping system 210 clamps to the wear part 104.

A clamp 212, of the plurality of clamps 212, may include at least one hydraulic actuator 228, or another component (e.g., a pneumatic actuator or an electrical actuator), that is configured to actuate the clamp 212 (e.g., to clamp the wear part 104). The operator of the wear part removal system 200 may interact with the one or more controls 206 to cause the plurality of clamps 212 to clamp the wear part 104 or to release the wear part 104. For example, the one or more controls 206, based on input by the operator, may send one or more control signals to the one or more hydraulic control components 222 to control (e.g., to activate or deactivate, pressurize or depressurize, and/or the like) the respective hydraulic actuators 228 of the plurality of clamps 212.

The vibrator device 214 may be configured to generate a vibratory force to the wear part 104 (e.g., via the contact component 216, as described herein). The vibrator device 214 may have an impact frequency of approximately 2,000-2,500 beats per minute and may generate a vibratory force of 3,500-9,000 lbs of force. A weight of the vibrator device 214 may be approximately 450-900 lbs and the vibrator device 214 may be configured to apply (e.g., as a pushing force) a portion of the weight to the wear part 104 (e.g., via the contact component 216, as described herein). In some implementations, the operator of the wear part removal system 200 may interact with the one or more controls 206 to cause the vibrator device 214 to activate or deactivate (e.g., to generate the vibratory force or to cease generating the vibratory force). For example, the one or more controls 206, based on input by the operator, may send one or more control signals to the vibrator device 214 to control (e.g., to activate or deactivate) operation of the vibrator device 214.

The contact component 216 may be configured to contact a portion of the wear part 104. For example, the contact component 216 may be configured to contact a top surface of the wear part 104 (e.g., before or after the clamping system 210 clamps the wear part 104). The contact component 216 may be configured to transmit the vibratory force generated by the vibrator device 214 to the portion of the wear part 104 and/or apply a portion of the weight of the vibrator device 214 to the portion of the wear part 104 (e.g., as a pushing, downward force on the wear part 104). For example, the contact component 216 may be attached to a bottom surface of the vibrator device 214 (e.g., by one or more fasteners), which allows the vibratory force generated by the vibrator device 214 to transmit from the vibrator device 214 to the portion of the wear part 104 via the contact component 216. This may also allow some or all of the weight of the vibrator device 214 to be applied on the contact component 216, which, accordingly, may apply the weight that has been applied to the contact component 216 to the portion of the wear part 104.

The contact component 216 may be configured to maintain contact with the portion of the wear part 104 (e.g., when transmitting the vibratory force from the vibrator device 214 to the portion of the wear part 104). For example, the contact component 216 may be associated with at least one hydraulic actuator 230, or another component (e.g., a pneumatic actuator or an electrical actuator), that is configured to secure the contact component 216 on the portion of the wear part 104 (e.g., configured to prevent the contact component 216 from lifting off the portion of the wear part 104 when the contact component 216 is transmitting the vibratory force from the vibrator device 214 to the portion of the wear part 104). Alternatively, the contact component 216 may be configured to float (e.g., bounce) on the portion of the wear part 104 (e.g., when transmitting the vibratory force from the vibrator device 214 to the portion of the wear part 104). For example, the at least one hydraulic actuator 230 may be configured to allow movement of the contact component 216 on the portion of the wear part 104 (e.g., configured to allow the contact component 216 to repeatedly lift off and on the portion of the wear part 104 when the contact component 216 is transmitting the vibratory force from the vibrator device 214 to the portion of the wear part 104).

The operator of the wear part removal system 200 may interact with the one or more controls 206 to control a tilt angle of the contact component 216 (e.g., with regard to the wear part 104, with regard to ground level, and/or the like) to allow the contact component 216 to be positioned on the portion of the wear part 104 (e.g., before the vibrator device 214 starts to generate the vibratory force). For example, the one or more controls 206, based on input by the operator, may send one or more control signals to the one or more hydraulic control components 222 to control (e.g., to activate or deactivate, pressurize or depressurize, and/or the like) the at least one hydraulic actuator 230 to cause a preferred tilt angle of the contact component 216 to be obtained.

The positioning system 218 may configured to control an approach angle of the wear part removal system 200 (e.g., with regard to the wear part 104, with regard to ground level, and/or the like) to the wear part 104 (e.g., to allow the clamping system 210 to clamp the wear part 104 and/or the contact component 216 to contact the wear part 104). In some implementations, the positioning system 218 may include the at least one suspension point 220 that is configured to attach to a lifting device (e.g., a boom of a crane) via rigging or other supporting material. Accordingly, the wear part removal system 200 may be suspended over or proximate to the wear part 104 by the lifting device via the at least one suspension point 220.

The positioning system 218 may include one or more other components (e.g., structural components) that attach to the base 202 or other components of the wear part removal system 200. In some implementations, the positioning system 218 may be pivotally connected to the base 202 by one or more positioning pivot points 232. A positioning pivot point 232 (e.g., that comprises a pivot pin or a similar pivoting component) may allow relative motion between the positioning system 218 and the base 202 (and/or other components of the wear part removal system 200).

The positioning system 218 may be associated with at least one hydraulic actuator 234, or another component (e.g., a pneumatic actuator or an electrical actuator), that is configured to control pivoting of the positioning system 218 via the one or more positioning pivot points 232. For example, the at least one hydraulic actuator 234 may activate to cause the positioning system 218 to pivot on the one or more positioning pivot points 232 until a preferred approach angle of the wear part removal system 200 is obtained. The operator of the wear part removal system 200 may interact with the one or more controls 206 to cause the at least one hydraulic actuator 234 to pivot the positioning system 218 via the one or more positioning pivot points 232 to obtain the preferred approach angle of the wear part removal system 200. For example, the one or more controls 206, based on input by the operator, may send one or more control signals to the one or more hydraulic control components 222 to control (e.g., to activate or deactivate, pressurize or depressurize, and/or the like) the at least one hydraulic actuator 234.

Additionally, or alternatively, the positioning system 218 may be associated with at least one accelerometer device (not shown) that is configured, in association with the at least one hydraulic actuator 234, to maintain the approach angle of the wear part removal system 200 (e.g., even when the vibrator device 214 is generating the vibratory force, the contact component 216 is floating on the wear part 104, the wear part 104 is removed or becomes dislodged from the clamping system 210, and/or the like). For example, the at least one accelerometer device may send a control signal to the at least one hydraulic actuator 234 when the at least one accelerometer device senses a change in acceleration (e.g., due to a shift in position of the positioning system 218 relative to the base 202 and/or other components of the wear part removal system 200) and may cause the at least one hydraulic actuator 234 to activate to cause the positioning system 218 to pivot on the one or more positioning pivot points 232 until the preferred approach angle of the wear part removal system 200 is reobtained.

The wear part removal system 200 may include one or more additional components. For example, the wear part removal system 200 may include a catch component (e.g., catch component 502 shown in FIG. 5) that is configured to capture the wear part 104 after the wear part 104 is removed by the wear part removal system 200 (e.g., after application of the pulling force, the pushing force, and/or the vibratory force on the wear part 104 by the wear part removal system 200, as described herein). The catch component may be configured to hold the wear part 104 (e.g., while the wear part removal system 200 is moved to another location). The catch component may include a mechanism, or may be otherwise configured, for the operator of the wear part removal system 200 to interact with the mechanism to cause the catch component to release (e.g., drop or place) the wear part 104 (e.g., in a waste receptacle). In this way, the wear part removal system 200 may facilitate both removal and disposal of the wear part 104.

As indicated above, FIGS. 2A-2D are provided as an example. Other examples may differ from what is described in connection with FIGS. 2A-2D.

Figure 3:
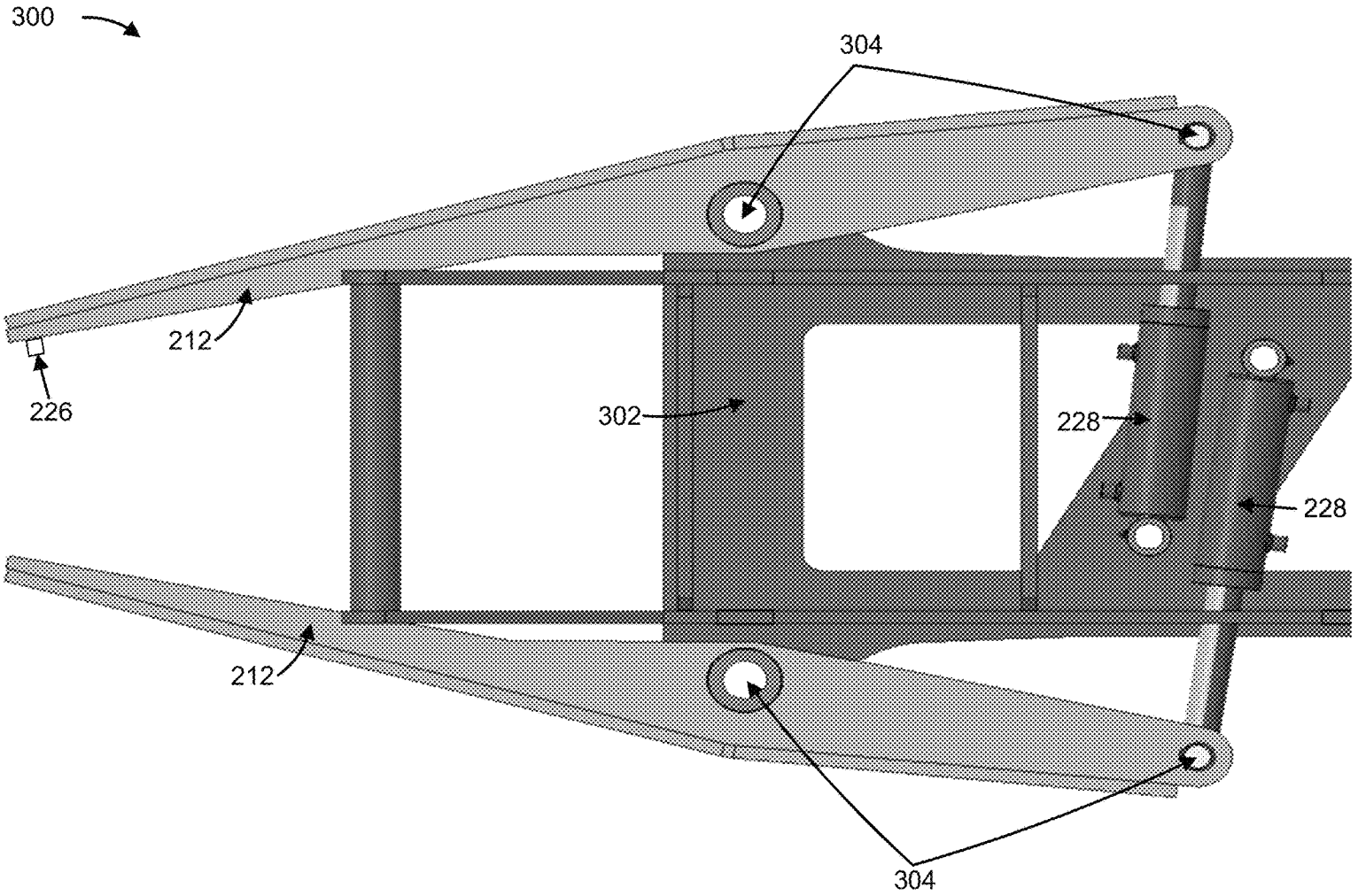
FIG. 3 is a top view diagram of an example clamping system described herein.

FIG. 3 is a top view diagram of an example clamping system 300 (e.g., that corresponds to the clamping system 210). As shown in FIG. 3, the clamping system 300 may include a plurality of clamps 212, where a clamp 212 may include an engagement component 226 and may be associated with at least one hydraulic actuator 228 (e.g. as described herein in relation to FIGS. 2A-2D). As further shown in FIG. 3, the clamping system 300 may include a clamp base 302 and one or more clamp pivot points 304. The clamp base 302 may provide a physical structure to support the plurality of clamps 212 and the hydraulic actuators 228 respectively associated with the plurality of clamps 212.

A clamp 212, of the plurality of clamps 212, may be pivotally connected to the clamp base 302 by at least one clamp pivot point 304 of the one or more clamp pivot points 304. The at least one clamp pivot point 304 (e.g., that comprises a pivot pin or a similar pivoting component) may allow relative motion between the clamp 212 and the clamp base 302. For example, a hydraulic actuator 228 associated with the clamp 212 may activate to cause the clamp 212 to pivot on the at least one clamp pivot point 304 to cause the clamp 212 to clamp the wear part 104 (e.g., as described herein).

As indicated above, FIG. 3 is provided as an example. Other examples may differ from what is described in connection with FIG. 3.

Figures 4A, 4B:
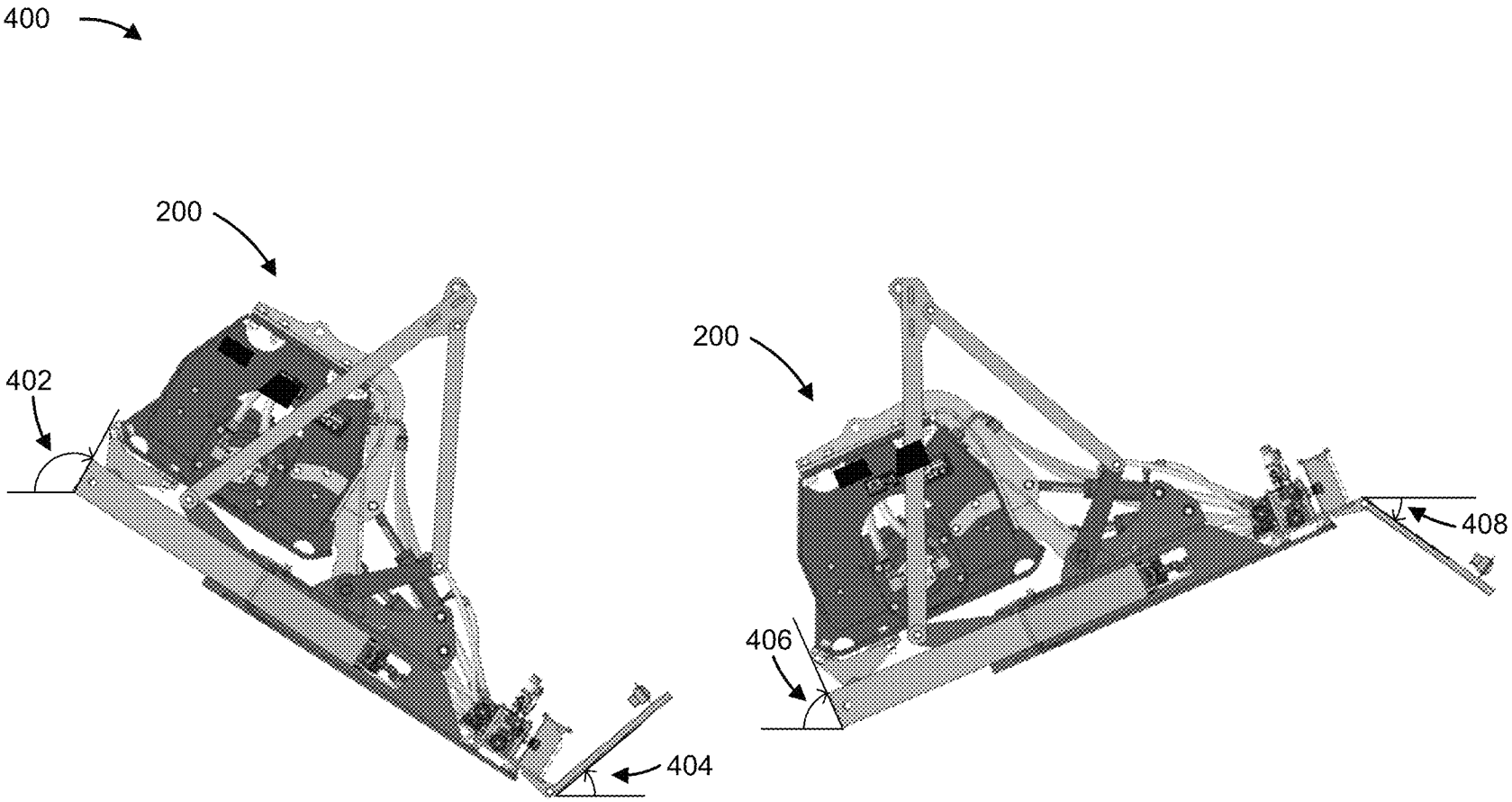
FIGS. 4A-4B are diagrams of example handle position angles and approach angles of the wear part removal system described herein.

FIGS. 4A-4B are diagrams 400 of example handle position angles and approach angles of the wear part removal system 200 described herein. As shown in FIG. 4A, the wear part removal system 200 may have an approach angle 402 to the wear part 104 and a handle position angle 404. For example, an operator of the wear part removal system 200 may interact with the one or more controls 206 to cause the at least one hydraulic actuator 234 to pivot the positioning system 218 via the one or more positioning pivot points 232 to cause the wear part removal system 200 to adjust to the approach angle 402. Additionally, or alternatively, the operator may interact with (e.g., "unlock") the handle pivot point 208 to cause the handle 204 to pivot to the handle position angle 404. As shown in FIG. 4B, the wear part removal system 200 may have an approach angle 406 to the wear part 104 and a handle position angle 408. For example, an operator of the wear part removal system 200 may interact with the one or more controls 206 to cause the at least one hydraulic actuator 234 to pivot the positioning system 218 via the one or more positioning pivot points 232 to adjust to the approach angle 406 (e.g., from the approach angle 402). Additionally, or alternatively, the operator may interact with the handle pivot point 208 to cause the handle 204 to pivot to the handle position angle 408 (e.g., from the handle position angle 404).

As indicated above, FIGS. 4A-4B are provided as an example. Other examples may differ from what is described in connection with FIGS. 4A-4B.

Figure 5B:
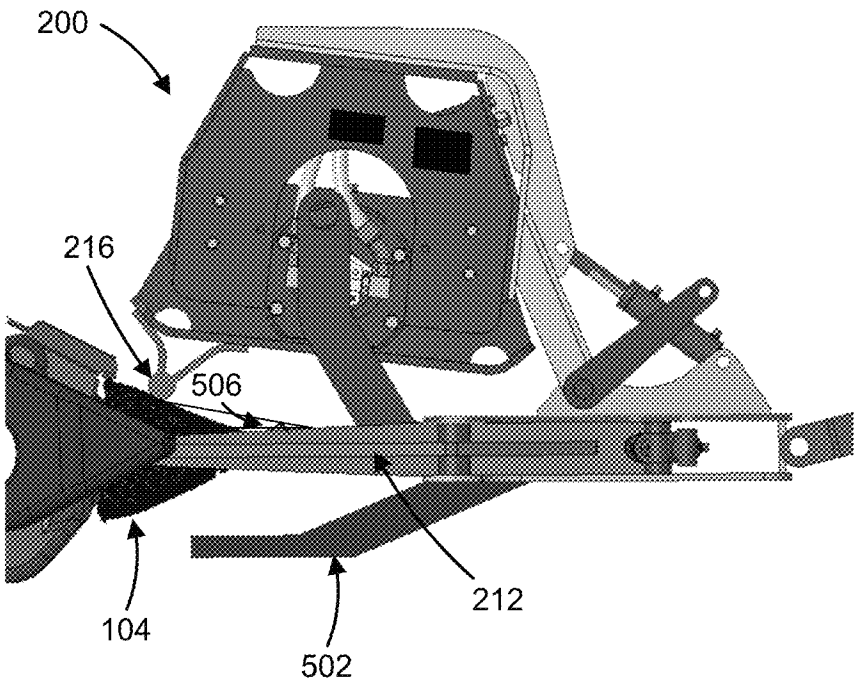
FIGS. 5A-5B are diagrams of example tilt angles of a contact component described herein.
Figure 5A:
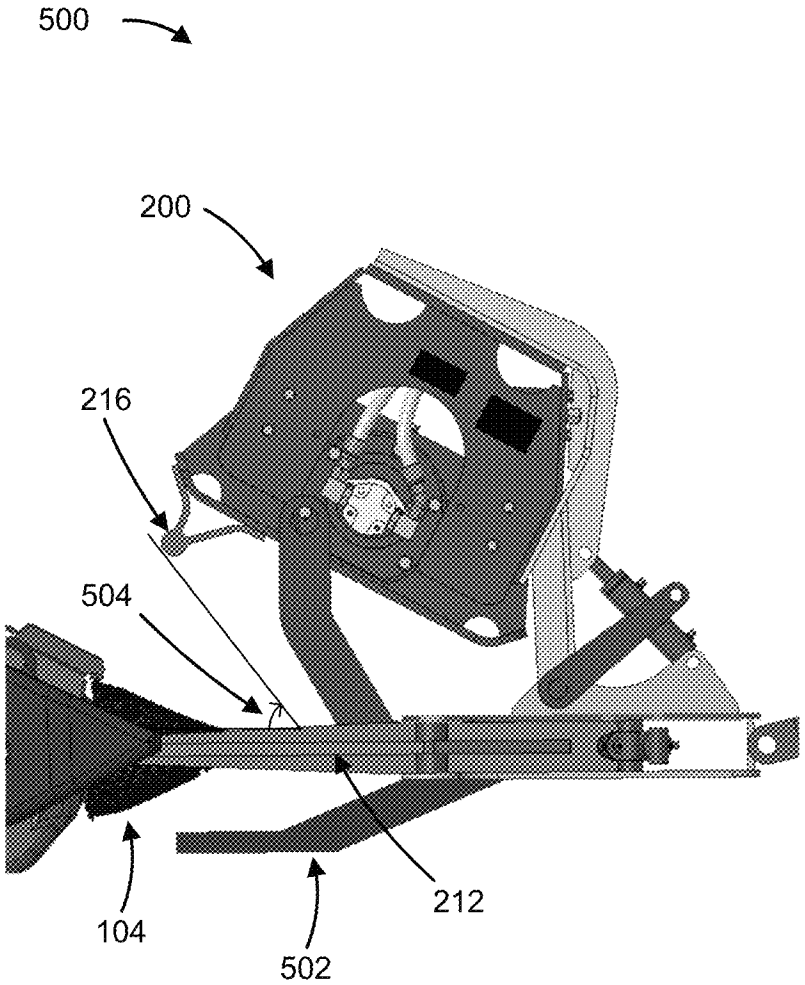

FIGS. 5A-5B are diagrams 500 of example tilt angles of the contact component 216. As shown in FIGS. 5A-5B, the wear part removal system 200 may include a catch component 502 (e.g., that corresponds to the catch component described herein in relation to FIGS. 2A-2D) for capturing the wear part 104 when the wear part 104 is removed by the wear part removal system 200. As further shown in FIG. 5A, the plurality of clamps 212 of the wear part removal system 200 may clamp the wear part 104, and the contact component 216 may have a tilt angle 504. For example, an operator of the wear part removal system 200 may interact with the one or more controls 206 to cause the at least one hydraulic actuator 230 to tilt the contact component 216 to the tilt angle 504 (e.g., to allow the plurality of clamps 212 to clamp the wear part 104 in an uninhibited manner before the contact component 216 is lowered to contact a top surface of the wear part 104). As further shown in FIG. 5B, the contact component 216 may have a tilt angle 506 that is smaller than the tilt angle 504 to allow the contact component 216 to contact the top of the wear part 104. For example, the operator of the wear part removal system 200 may interact with the one or more controls 206 to cause the at least one hydraulic actuator 230 to tilt the contact component 216 to the tilt angle 506 (e.g., to allow the contact component 216 to contact the top surface of the wear part 104 and to apply, to the top surface of the wear part 104, a portion of the weight of the vibrator device 214 and/or the vibratory force generated by the vibrator device 214).

As indicated above, FIGS. 5A-5B are provided as an example. Other examples may differ from what is described in connection with FIGS. 5A-5B.

INDUSTRIAL APPLICABILITY

Some implementations described herein provide a wear part removal system that enables removal of a wear part (e.g., from an adapter). The wear part removal system includes a handle and one or more controls that are configured to allow an operator of the wear part removal system to control how the wear part removal system approaches, lines up with, attaches, and/or applies one or more forces (e.g., a pulling force, a pushing force, and/or a vibratory force) to the wear part to facilitate removal of the wear part. For example, the operator may interact with the handle and the one or more controls to control a positioning system of the wear part removal system to control an approach angle of the wear part removal system to the wear part, to control a clamping system of the wear part removal system to cause the clamping system to clamp the wear part, and/or to control a tilt angle of a contact component of the wear part removal system to cause the contact component to contact a portion of the wear part and apply a pushing force (e.g., that is associated with a portion of the weight of a vibrator device of the wear part removal system) on the wear part. Further, the operator may pull on the handle to cause a pulling force to be applied to the wear part (e.g., via the clamping system) and/or may interact with the one or more controls to cause the vibrator device to activate to cause a vibratory force to be applied to the wear part (e.g., via the contact component). Accordingly, the wear part removal system may cause the wear part to be removed.

In this way, the wear part removal system allows for removal of a wear part, regardless of whether the wear part is stuck on an adapter or mount (e.g., because of impacted fines, dust, or dirt). Further, because the wear part removal system utilizes multiple components to contact and/or grip a wear part and is configured to apply more than one type of force on the wear part, the wear part removal system is able to quickly and efficiently remove wear parts that would otherwise be difficult and/or time consuming to remove using conventional removal techniques. For example, when a clamp of the clamping system includes an engagement component that engages with a retention aperture of a wear part, the clamping system may be able to clamp and maintain a firm grip on the wear part, even when the wear part is smooth from wear or otherwise damaged. As another example, the wear part removal system may contact a wear component (e.g., via the contact component) and apply a pushing force and/or vibratory force on the wear part to remove the wear part, without gripping the wear component. This is beneficial when environmental conditions prevent the wear part from being clamped by the clamping system (e.g., the wear part is wet or covered in ice).

The foregoing disclosure provides illustration and description, but is not intended to be exhaustive or to limit the implementations to the precise forms disclosed. Modifications and variations may be made in light of the above disclosure or may be acquired from practice of the implementations. Furthermore, any of the implementations described herein may be combined unless the foregoing disclosure expressly provides a reason that one or more implementations cannot be combined. Even though particular combinations of features are recited in the claims and/or disclosed in the specification, these combinations are not intended to limit the disclosure of various implementations. Although each dependent claim listed below may directly depend on only one claim, the disclosure of various implementations includes each dependent claim in combination with every other claim in the claim set.

As used herein, "a," "an," and a "set" are intended to include one or more items, and may be used interchangeably with "one or more." Further, as used herein, the article "the" is intended to include one or more items referenced in connection with the article "the" and may be used interchangeably with "the one or more." Further, the phrase "based on" is intended to mean "based, at least in part, on" unless explicitly stated otherwise. Also, as used herein, the term "or" is intended to be inclusive when used in a series and may be used interchangeably with "and/or," unless explicitly stated otherwise (e.g., if used in combination with "either" or "only one of"). Further, spatially relative terms, such as "below," "lower," "above," "upper," and the like, may be used herein for ease of description to describe one element or feature's relationship to another element(s) or feature(s) as illustrated in the figures. The spatially relative terms are intended to encompass different orientations of the apparatus, device, and/or element in use or operation in addition to the orientation depicted in the figures. The apparatus may be otherwise oriented (rotated 90 degrees or at other orientations) and the spatially relative descriptors used herein may likewise be interpreted accordingly.

What is claimed is:

1. A wear part removal system, comprising:
- a positioning system configured to control an approach angle of the wear part removal system to a wear part;
- a clamping system that includes a plurality of clamps and that is configured to clamp the wear part;
- a contact component configured to contact a portion of the wear part;
- at least one hydraulic actuator configured to position the contact component on the portion of the wear part; and
- a vibrator device configured to generate a vibratory force, wherein the contact component is configured to float on the portion of the wear part while transmitting the vibratory force from the vibrator device to the portion of the wear part.

2. The wear part removal system of claim 1, further comprising:
- a handle configured to facilitate application of a pulling force on the wear part when the wear part is clamped by the clamping system.

3. The wear part removal system of claim 1, further comprising:
- a handle; and
- a damper component configured to reduce the vibratory force generated by the vibrator device that transmits to the handle.

4. The wear part removal system of claim 1, further comprising:
- a handle that includes one or more controls that are configured to control at least one of:
  - a tilt angle of the contact component;
  - the approach angle of the wear part removal system;
  - activation or deactivation of the plurality of clamps of the clamping system; or
  - activation or deactivation of the vibrator device.

5. The wear part removal system of claim 1, wherein a clamp, of the plurality of clamps, includes a component configured to engage a retention aperture of the wear part when the wear part is clamped by the clamping system.

6. The wear part removal system of claim 1, wherein the contact component is configured to apply a portion of a weight of the vibrator device to the portion of the wear part as a pushing force on the wear part.

7. The wear part removal system of claim 1, wherein the positioning system is configured to maintain the approach angle of the wear part removal system when the vibrator device is generating the vibratory force.

8. The wear part removal system of claim 1, further comprising:

a catch component configured to capture the wear part when the wear part is removed by the wear part removal system.

9. The wear part removal system of claim 1, wherein the wear part is a ground engaging tool.

10. A wear part removal system, comprising:

a positioning system configured to control an approach angle of the wear part removal system to a wear part;

a clamping system that is configured to clamp the wear part to facilitate removal of the wear part, wherein the clamping system includes a plurality of clamps and a clamp base, wherein a clamp, of the plurality of clamps, includes a first end and a second end, wherein the first end is connected to a hydraulic actuator, wherein the second end is configured to clamp the wear part, wherein the clamp is pivotally connected to the clamp base by a clamp pivot point, and wherein the clamp pivot point is between the first end and the second end; and a contact component configured to contact a portion of the wear part to facilitate the removal of the wear part, wherein the contact component is configured to transmit a vibratory force generated by a vibrator device to the portion of the wear part, and wherein the contact component is configured to float on the portion of the wear part when transmitting the vibratory force to the portion of the wear part.

11. The wear part removal system of claim 10, wherein the second end includes a component configured to engage a retention aperture of the wear part when the clamping system clamps the wear part.

12. The wear part removal system of claim 10, wherein the hydraulic actuator enables the clamp to apply a clamping force when the clamping system clamps the wear part.

13. The wear part removal system of claim 10, wherein the positioning system comprises at least one hydraulic actuator and at least one accelerometer device, and wherein the at least one hydraulic actuator and the at least one accelerometer device are configured to maintain the approach angle of the wear part removal system when the contact component is transmitting a vibratory force to the portion of the wear part.

14. The wear part removal system of claim 10, wherein the hydraulic actuator is configured to cause the clamp to pivot on the clamp pivot point.

15. A wear part removal system, comprising:

a positioning system configured to control and maintain an approach angle of the wear part removal system with respect to a wear part, wherein the wear part is a ground engaging tool;

a clamping system that is configured to clamp the wear part to facilitate removal of the wear part, wherein the clamping system includes a clamp that includes an engagement component configured to insert into a retention aperture of the wear part when the clamping system clamps the wear part, and wherein the engagement component is a fastener, a pin, or a rod, and wherein the engagement component is spaced from an end of the clamp; and a contact component configured to transmit a vibratory force generated by a vibrator device to a portion of the wear part, wherein the contact component is configured to float on the portion of the wear part when transmitting the vibratory force to the portion of the wear part.

16. The wear part removal system of claim 15, wherein the clamping system includes an additional component configured to provide grip on the wear part when the clamping system clamps the wear part.

17. The wear part removal system of claim 15, wherein the clamp further includes a hydraulic actuator that enables the component to apply a clamping force when the clamping system clamps the wear part.

18. The wear part removal system of claim 15, wherein the positioning system comprises at least one hydraulic actuator and at least one accelerometer device, and wherein the at least one hydraulic actuator and the at least one accelerometer device are configured to maintain the approach angle of the wear part removal system when the clamping system clamps the wear part.

19. The wear part removal system of claim 15, wherein the positioning system includes one or more components configured to attach to a lifting device to facilitate positioning of the wear part removal system with respect to the wear part.

20. The wear part removal system of claim 15, wherein the engagement component is the fastener.

* * * * *